US011197523B2

(12) United States Patent
Liu

(10) Patent No.: US 11,197,523 B2
(45) Date of Patent: Dec. 14, 2021

(54) AUXILIARY HANDLE FOR A WALKING ASSISTANCE DEVICE

(71) Applicant: HOMECARE ENTERPRISE CO., LTD., Changhua (TW)

(72) Inventor: Shih-Chieh Liu, Changhua (TW)

(73) Assignee: HOMECARE ENTERPRISE CO., LTD., Changhua (TW)

( * ) Notice: Subject to any disclaimer, the term of this patent is extended or adjusted under 35 U.S.C. 154(b) by 0 days.

(21) Appl. No.: 17/037,614

(22) Filed: Sep. 29, 2020

(65) Prior Publication Data

US 2021/0093056 A1 Apr. 1, 2021

(30) Foreign Application Priority Data

Sep. 30, 2019 (TW) ..... 108212933

(51) Int. Cl.
*A45B 9/02* (2006.01)
*A45B 9/00* (2006.01)

(52) U.S. Cl.
CPC ..... *A45B 9/02* (2013.01); *A45B 2009/005* (2013.01)

(58) Field of Classification Search
CPC .. A45B 9/02; A45B 2009/005; Y10T 16/4713
See application file for complete search history.

(56) References Cited

U.S. PATENT DOCUMENTS 1,400,394 A * 12/1921 Warry ..... A61H 3/02 135/69
2,536,607 A * 1/1951 Jenkins ..... A01D 7/02 56/400.17
2,690,188 A * 9/1954 Goddard ..... A61H 3/02 135/72
5,771,910 A * 6/1998 Kluttz ..... A61H 3/02 135/68
5,845,664 A * 12/1998 Ryder ..... A45B 3/04 135/65
6,990,990 B2 * 1/2006 Wilensky ..... A61H 3/00 135/67
7,191,494 B2 * 3/2007 Badiali ..... B25F 5/026 16/426
7,347,215 B1 * 3/2008 Birnbaum ..... A61H 3/0277 135/66
8,714,171 B1 * 5/2014 Haygood ..... A61G 7/1038 135/66
2012/0031447 A1 * 2/2012 Lai ..... A45B 9/02 135/75

* cited by examiner

*Primary Examiner* — Noah Chandler Hawk

(57) ABSTRACT

An auxiliary handle for a walking assistance device has a tube seat and a handgrip tube. The tube seat utilizes the positioning space for accepting a crutch tube. When a user holds the handle portion of the handgrip tube and turns it downward; when the handgrip tube is turned, the positioning protrusion of the connecting portion moves from the stopping portion to the positioning portion and compresses the elastic member. When the handgrip tube is horizontal, the positioning protrusion passes over the stopping edge and inserts into the positioning portion for positioning to lock the handgrip tube and prevent the elastic member from rebounding. Meanwhile, the user holds a top grip on the top of the walking assistance device with one hand, and holds the handgrip tube with the other hand, and then applies force to support the body to get up and stand.

9 Claims, 8 Drawing Sheets

AUXILIARY HANDLE FOR A WALKING ASSISTANCE DEVICE

BACKGROUND of INVENTION

Field of Invention

The present invention relates to an auxiliary handle, and more particularly to an auxiliary handle for a walking assistance device.

Description of Related Art

For the elderly people or people with mobility impairments, they often have difficulty in moving due to the inability of walking, and they are prone to fall due to unstable center of gravity, so they often use walking assistance device such as crutches to help support their body's center of gravity to be more stable and safer when walking. However, traditional crutches have of telescopic adjustment to adapt to different heights, but the set length of crutches is usually the use height of standing or walking. When users get up and stand from a sitting position, they need better grip assistance, but the set height of the crutch becomes too high to help the user to get up from a sitting posture.

Therefore, it is desirable to provide an auxiliary handle for a walking assistance device to mitigate and/or obviate the aforementioned problems.

SUMMARY of INVENTION

An objective of present invention is to provide an auxiliary handle for a walking assistance device, which is capable of improving the above-mention problems.

In order to achieve the above mentioned objective, an auxiliary handle for a walking assistance device has a tube seat and a handgrip tube. The tube seat utilizes the positioning space for accepting a crutch tube. When a user holds the handle portion of the handgrip tube and turns it downward; when the handgrip tube is turned, the positioning protrusion of the connecting portion moves from the stopping portion to the positioning portion and compresses the elastic member. When the handgrip tube is horizontal, the positioning protrusion passes over the stopping edge and be inserts into the positioning portion for positioning to lock the handgrip tube and prevent the elastic member from rebounding. Meanwhile, the user holds a top grip on the top of the walking assistance device with one hand, and holds the handgrip tube with the other hand, and then applies force to support the body to get up and stand.

Other objects, advantages, and novel features of invention will become more apparent from the following detailed description when taken in conjunction with the accompanying drawings.

DETAILED DESCRIPTION OF PREFERRED EMBODIMENT

Figure 1:
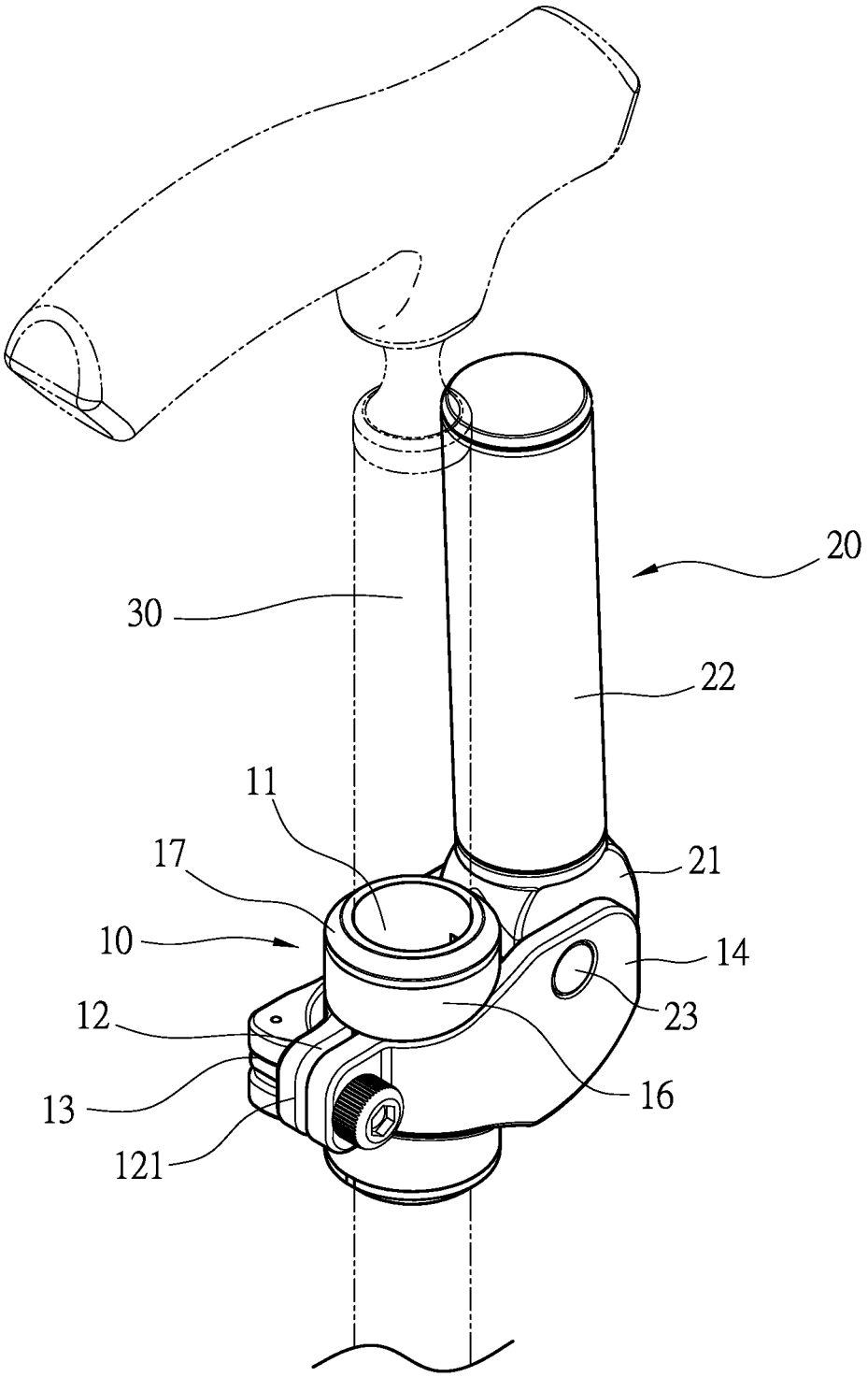
FIG. 1 is a three-dimensional picture of a preferred embodiment according to the present invention.
Figure 2:
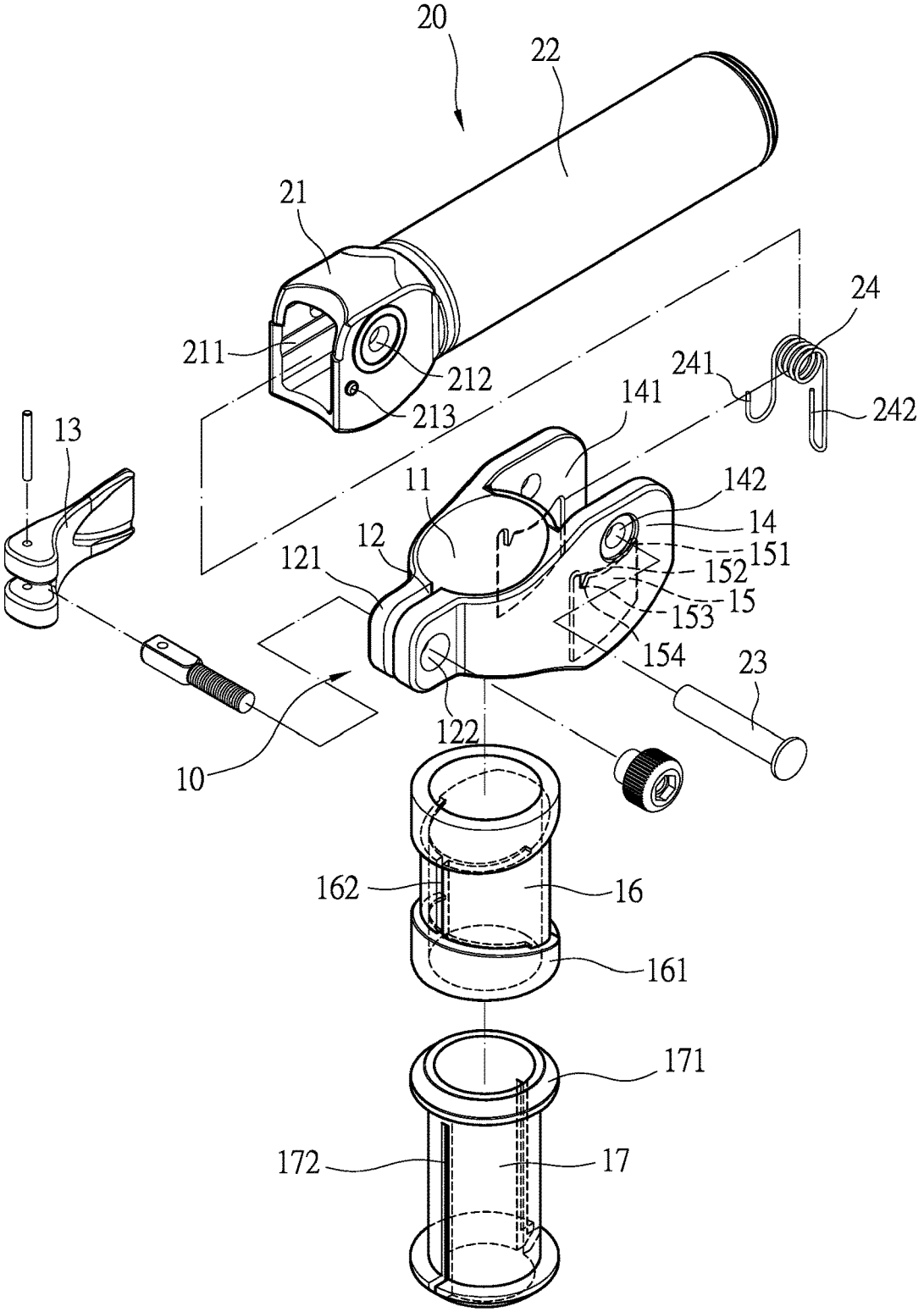
FIG. 2 is an exploded view of the preferred embodiment according to the present invention.

Please refer to FIG. 1 and FIG. 2. An auxiliary handle for a walking assistance device comprises: a tube seat 10 and a handgrip tube 20. The tube seat 10 has a positioning space 11 for accepting a crutch tube 30 and a groove 12 connected to the positioning space 11 and assembled with a quick release unit 13. The tube seat 10 further comprises two tightening lugs 121 with a through aperture 122 engaging with quick release unit 13 respectively on each side of the groove 12. The tube seat 10 further comprising an assembling portion 14 at another side. The assembling portion 14 comprises two symmetrical lugs and an assembling space 141 in between the lugs, a pivoting aperture 142 respectively and correspondingly disposed on the two lugs, and one positioning groove 15 is respectively disposed on an inner side of each lug. The positioning groove 15 has a horizontal positioning stopping portion 151, a vertical positioning portion 152. The positioning portion 152 further comprises a stopping edge 153 at one end and is connected to a guiding incline 154. The positioning space 11 is assembled with a first bushing 16 and a second bushing 17. The first bushing 16 respectively comprises a stopping end 161 with a larger diameter at both ends, and the first bushing further comprises a through slot 162 between the two stopping ends 161. The second bushing 17 is disposed in the first bushing and has an abutting portion respectively at both ends and a through slot connected to the abutting portions at a lower end. The second bushing 17 is disposed in the first bushing 16 and has an abutting portion 171 respectively at both ends and a through slot 172 connected to the abutting portions 171 at a lower end. The handgrip tube 20 has a connecting portion 21 and a handle portion 22. The connecting portion 21 has an open chamber 211. The connecting portion 21 has a pivoting aperture 212 and a positioning protrusion 213 on two opposite sidewalls. The connecting portion 21 is pivoted with the assembling portion 14 of the tube seat 10 by a shaft bolt 23, so the handgrip tube 20 rotates around the shaft bolt 23. An elastic member 24 is disposed between the connecting portion 21 and the assembling portion 14 in the open chamber 211 and secured by the shaft bolt 23, and the elastic member 24 has a first end 241 pushing against the assembling space 141 of the assembling portion 14 and a second end 241 pushing against the open chamber 211. Furthermore, the handle portion 22 is hollow, and the handgrip tube 22 is covered with an over layer 221.

Figure 3:
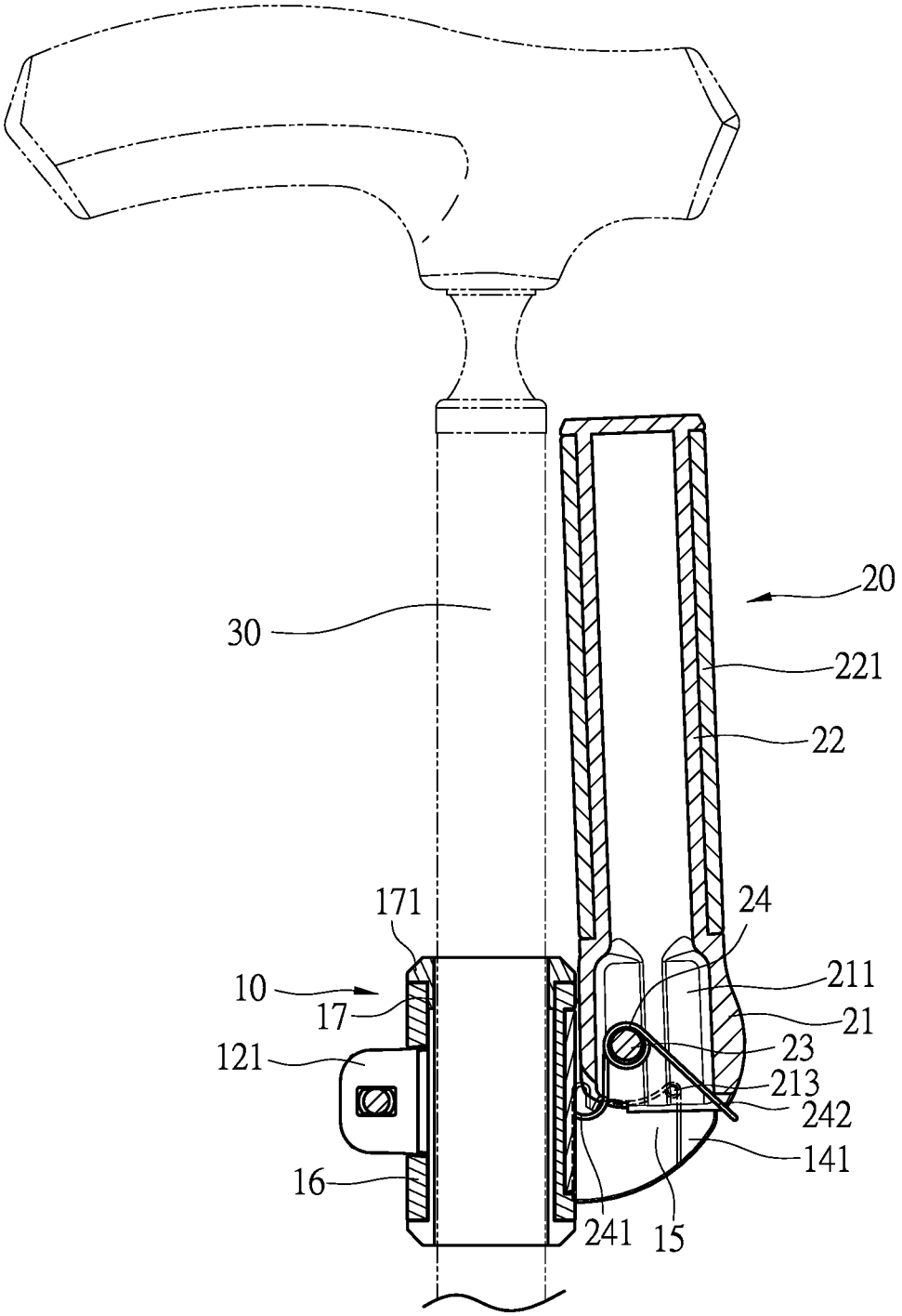
FIG. 3 is a cross-sectional view of the preferred embodiment in the collapsed state according to the present invention.
Figure 4:
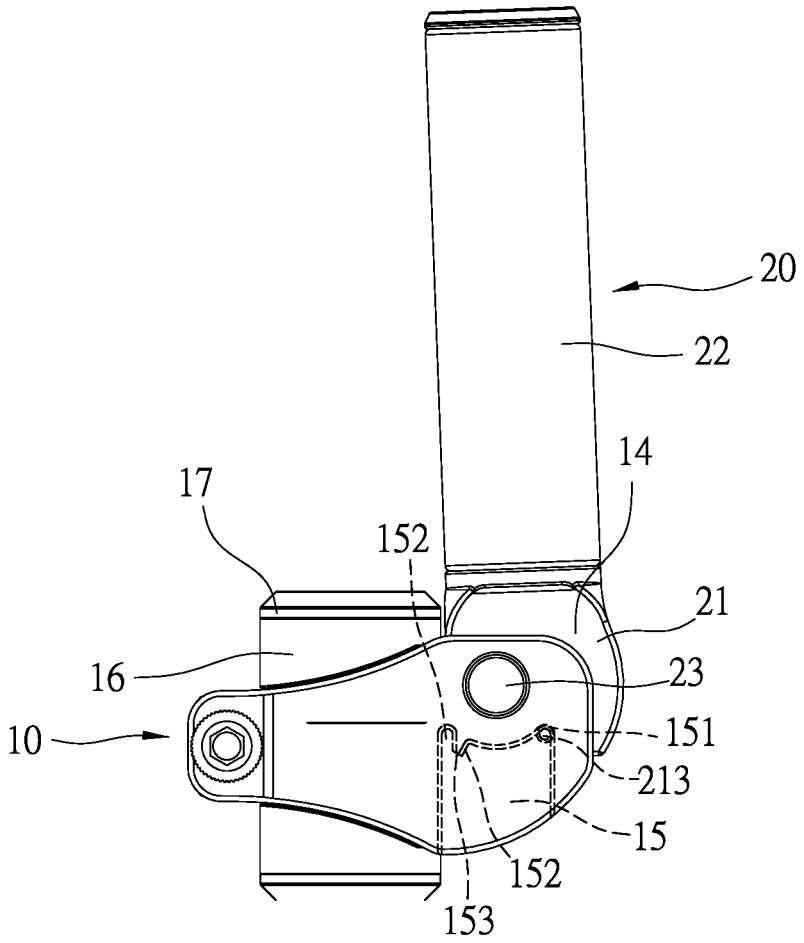
FIG. 4 is a schematic diagram of the preferred embodiment in the collapsed state according to the present invention.
Figure 5:
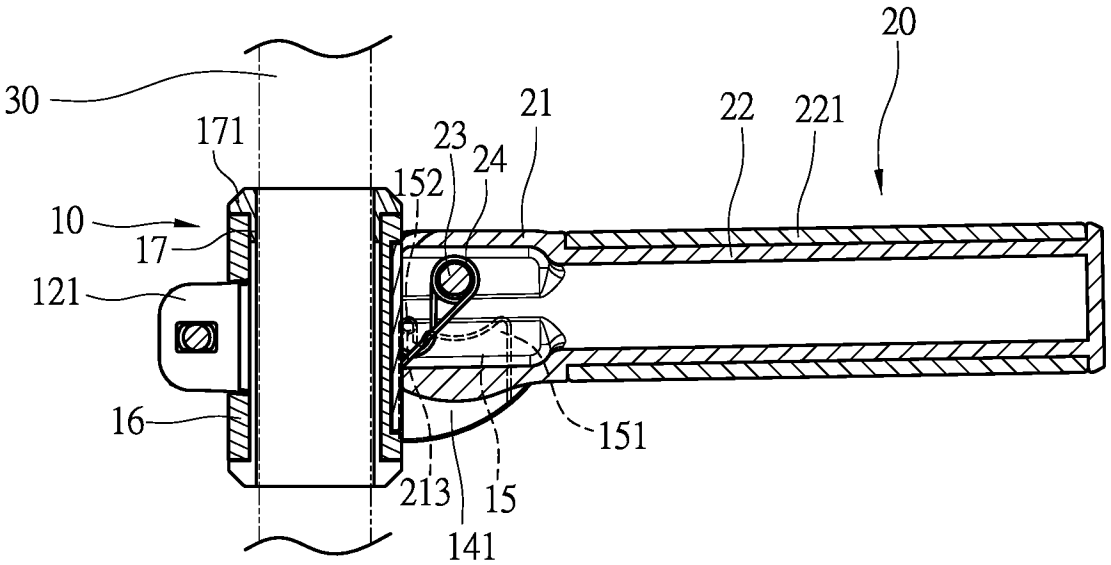
FIG. 5 is a cross-sectional view of the preferred embodiment in a horizontally expanded state according to the present invention.
Figure 6:
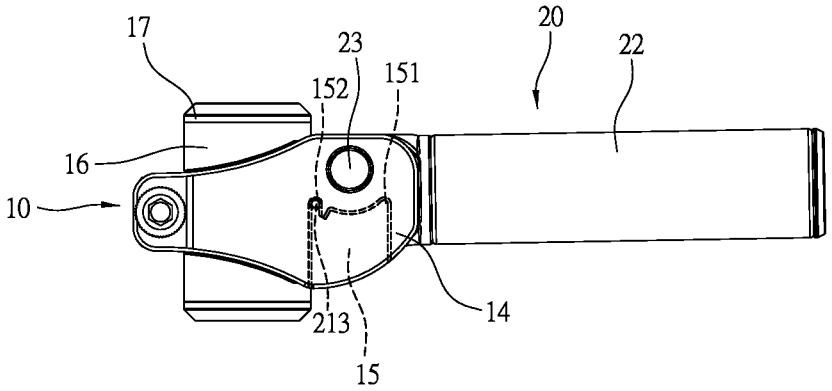
FIG. 6 is a schematic drawing of the preferred embodiment in a horizontally expanded state according to the present invention.
Figure 7:
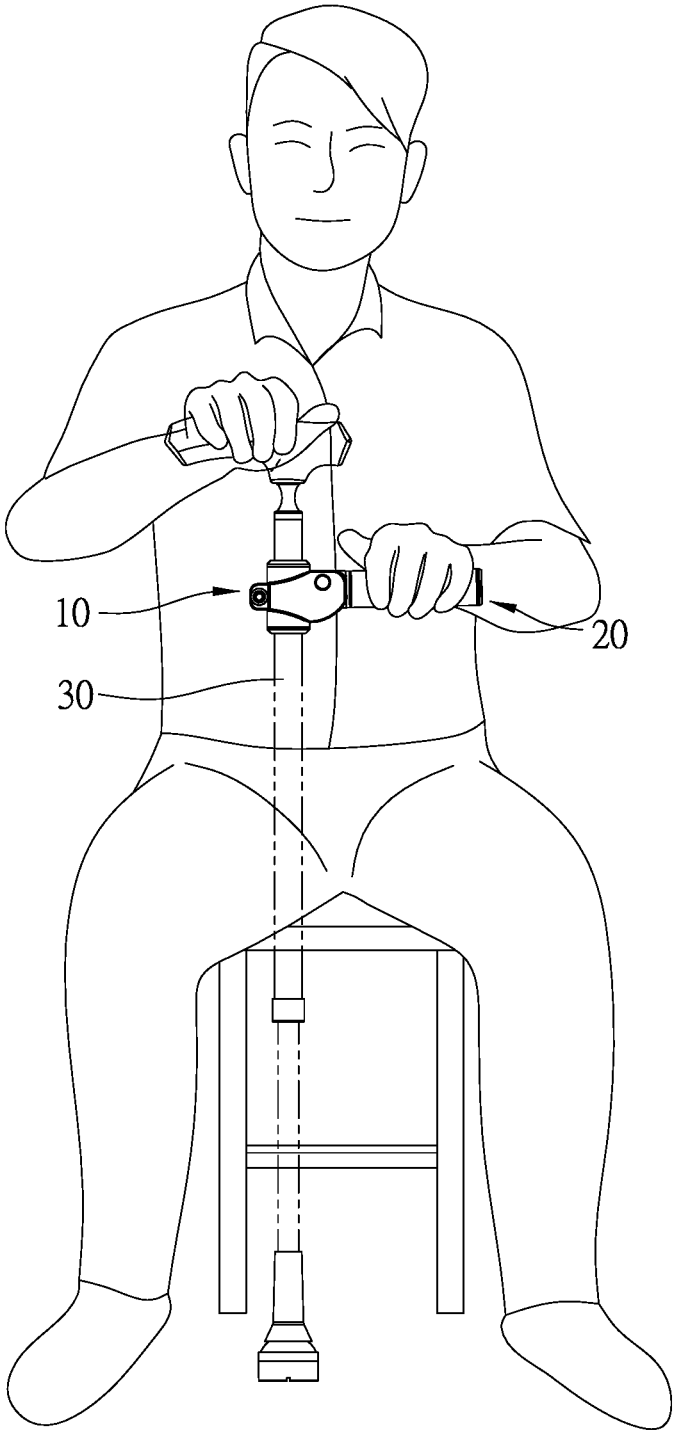
FIG. 7 is a schematic drawing when a user is in the sitting state and holding the crutches and the handgrip tube according to the present invention.
Figure 8:
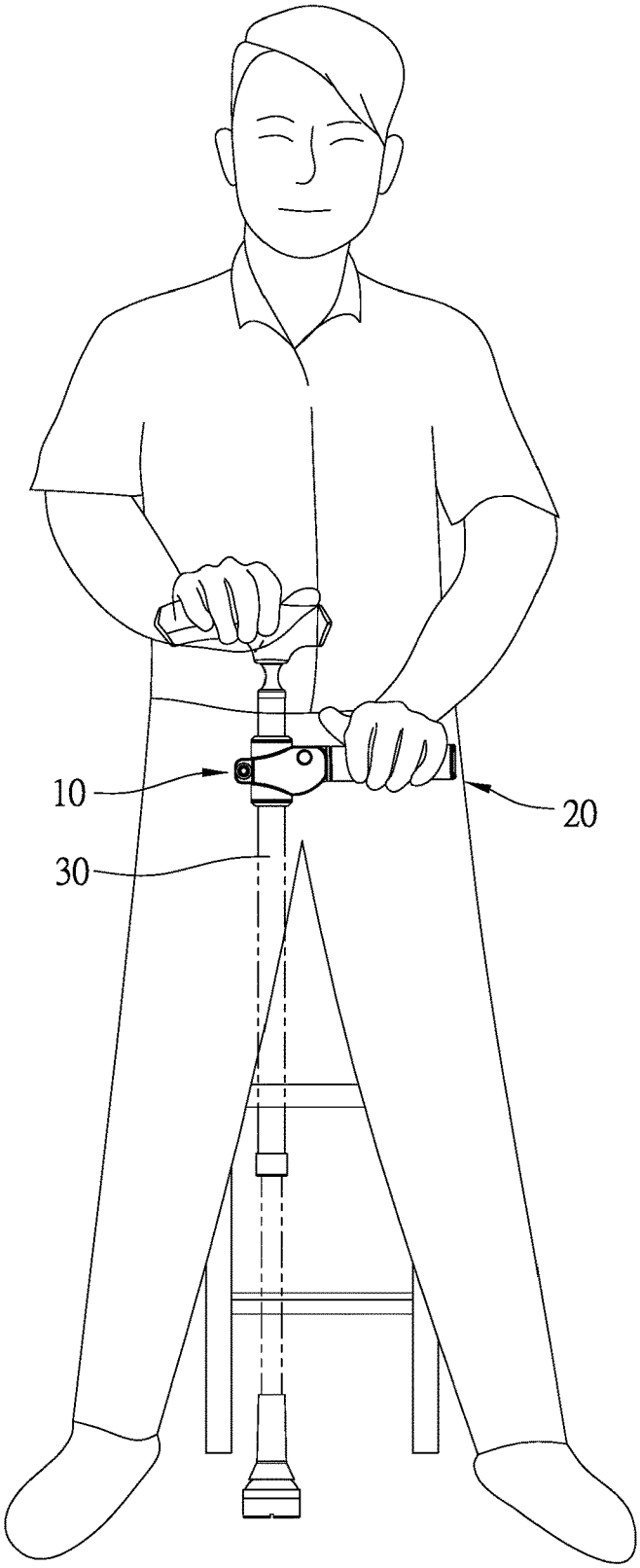
FIG. 8 is a schematic drawing when a user is standing and holding the walking assistance device and the handgrip tube according to the present invention.

For assembly, please refer to FIG. 2 and FIG. 3. The handgrip tube 20 is installed in the assembling space 141 of the tube seat 10 with the connecting portion 21, the pivoting aperture 212 is aligned with the pivoting apertures 142 of the two lugs, the positioning protrusions 213 on both sides respectively insert into the two positioning groove 15, and the elastic member 24 is accommodated in the open chamber 211 of the connecting portion 21. Afterward, the shaft bolt 23 is pivotally positioned through the pivoting aperture 142 and the pivoting aperture 212 and then inserted through the elastic member 24 to be restricted in the open chamber 211, the first end 241 of the elastic member 24 pushes against the inner wall of the assembling space 141, and the second end 242 pushes against the inner wall of the open chamber 211, so the connecting portion 21 of the handgrip tube 20 is able to rotate around the shaft bolt 23 as the axis in the assembling space 141. Moreover, the positioning protrusion 213 on the outer wall of the connecting portion 21 is able to move and being limited in the positioning groove 15, and the elastic member 24 assists the handgrip tube 20 to rebound and reset.

For actual use, please refer to FIGS. 3, 4, 5, 6 and FIGS. 7 and 8. The auxiliary handle is installed in a crutch tube 30 via the positioning space 11 of the tube seat 10, which can be adjusted according to the height of the user and the position of convenient grip and secured by the quick release unit 13. When the handgrip tube 20 is not in use, it can be flipped up to be vertical and adjacent to the crutch tube 30, and the positioning protrusion 213 of the connecting portion 21 abuts against the stopping portion 151 of the positioning groove 15. In order to use the device, the user holds the handle portion 22 of the handgrip tube 20 and turns it downward; when the handgrip tube 20 is turned, the positioning protrusion 213 of the connecting portion 21 moves from the stopping portion 151 to the positioning portion 152 and compresses the elastic member 24. When the handgrip tube 20 is horizontal and vertical to the crutch tube 30, the positioning protrusion 213 passes over the stopping edge 153 and be inserts into the positioning portion 152 for positioning to lock the handgrip tube 20 and prevent the elastic member 24 from rebounding. Meanwhile, the user holds a top grip on the top of the walking assistance device with one hand, and holds the handgrip tube 20 with the other hand to keep the center of gravity at the front and the walking assistance device, and then applies force to support the body to get up and stand, while avoiding the occurrence of unstable center of gravity and falling and ensuring the safety.

Furthermore, after getting up and standing, the handgrip tube 20 can be retracted to avoid inconvenient. For the retracting action of the handgrip tube 20, please refer to FIGS. 5 and 3. First, the handgrip tube 20 is slightly lifted to make the positioning protrusion 213 to move along the guiding incline 154 and away from the positioning portion 152, so that the elastic member 24 is used to drive the handgrip tube 20 to slowly rotate upward to reset, which makes the positioning protrusion 213 to abut against the stopping portion 151 and to retract the handgrip tube 20.

Although the present invention has been explained in relation to its preferred embodiment, it is to be understood that many other possible modifications and variations can be made without departing from the spirit and scope of invention as hereinafter claimed.

What is claimed is:

1. An auxiliary handle for a walking assistance device comprising: a tube seat and a handgrip tube, the tube seat having a positioning space for accepting a crutch tube and a groove connected to the positioning space and assembled with a quick release unit; the positioning space comprising a first bushing and a second bushing, the tube seat further comprising an assembling portion at another side; the handgrip tube having a connecting portion and a handle portion, the connecting portion pivoted with the assembling portion of the tube seat via a shaft bolt, at least one positioning protrusion and at least one positioning groove respectively and correspondingly disposed on the connecting portion and the assembling portion, the positioning groove having a horizontal positioning stopping portion and a vertical positioning portion, and an elastic member disposed between the connecting portion and the assembling portion.

2. The auxiliary handle for a walking assistance device as claimed in claim 1, wherein the tube seat further comprises two tightening lugs with a through aperture respectively on each side of the groove.

3. The auxiliary handle for a walking assistance device as claimed in claim 1, wherein the first bushing respectively comprises a stopping end with a larger diameter at both ends, the first bushing further comprises a through slot between the two stopping ends, and the second bushing is disposed in the first bushing and has an abutting portion respectively at both ends and a through slot connected to the abutting portions at a lower end.

4. The auxiliary handle for a walking assistance device as claimed in claim 1, wherein the assembling portion of the tube seat comprises two symmetrical lugs and an assembling space in between the lugs, a pivoting aperture respectively and correspondingly disposed on the two lugs, and one positioning groove is respectively disposed on an inner side of each lug.

5. The auxiliary handle for a walking assistance device as claimed in claim 4, wherein the positioning portion of the positioning groove further comprises a stopping edge at one end and is connected to a guiding incline.

6. The auxiliary handle for a walking assistance device as claimed in claim 4, wherein a positioning protrusion is disposed respectively on two opposite sidewalls of the connecting portion.

7. The auxiliary handle for a walking assistance device as claimed in claim 1, wherein the positioning portion of the positioning groove further comprises a stopping edge at one end and is connected to a guiding incline.

8. The auxiliary handle for a walking assistance device as claimed in claim 1, wherein the connecting portion has an open chamber, the elastic member is disposed in the open chamber and secured by the shaft bolt, and the elastic member has a first end pushing against the assembling portion and a second end pushing against the open chamber.

9. The auxiliary handle for a walking assistance device as claimed in claim 1, wherein the handle portion of the handgrip tube is hollow, and the handgrip tube is covered with an over layer.

* * * * *